US006347563B1

(12) United States Patent
Witt

(10) Patent No.: US 6,347,563 B1
(45) Date of Patent: Feb. 19, 2002

(54) TOOL FOR REMOVING DRAIN CAPS

(76) Inventor: Gary E. Witt, 328 Walnut St., Elmhurst, IL (US) 60126

( * ) Notice: Subject to any disclaimer, the term of this patent is extended or adjusted under 35 U.S.C. 154(b) by 0 days.

(21) Appl. No.: 09/765,660

(22) Filed: Jan. 22, 2001

(51) Int. Cl.[7] ..... B25B 13/06
(52) U.S. Cl. ..... 81/121.1; 81/124.2
(58) Field of Search ..... 81/121.1, 124.2, 81/125, 125.1, 457, 176.15

(56) References Cited

U.S. PATENT DOCUMENTS

| | | | | | |
|---|---|---|---|---|---|
| 107,255 | A | * | 9/1870 | Harris | 81/124.2 |
| 342,824 | A | * | 6/1886 | Clark | 81/124.2 |
| 887,643 | A | * | 5/1908 | Jackson | 81/124.2 |
| 1,181,565 | A | * | 5/1916 | Block | 81/124.2 |
| 4,077,103 | A | | 3/1978 | Kelley | |
| 4,125,913 | A | * | 11/1978 | Lewis | 81/124.2 |
| D261,606 | S | | 11/1981 | La Fargo et al. | |
| 4,339,971 | A | * | 7/1982 | Zatorre | 81/437 |
| 4,436,004 | A | * | 3/1984 | Chang | 81/60 |
| 4,691,424 | A | | 9/1987 | Schmidt et al. | |
| 4,806,170 | A | | 2/1989 | Doty | |
| 4,836,065 | A | * | 6/1989 | Setliff | 81/124.2 |
| 5,003,682 | A | | 4/1991 | Strausbaugh et al. | |
| 5,090,276 | A | * | 2/1992 | Groskey | 81/176.15 |
| D329,969 | S | * | 10/1992 | Kemp | 81/124.2 |
| 5,685,207 | A | | 11/1997 | Hubert | |
| 5,819,610 | A | * | 10/1998 | Brannan | 81/437 |
| 6,016,728 | A | * | 1/2000 | Bohl | 81/437 |

* cited by examiner

*Primary Examiner*—James G. Smith
*Assistant Examiner*—Hadi Shakeri

(57) ABSTRACT

A tool for removing drain caps for removing a drain cap. The tool for removing drain caps includes a rod that elongate and has a first end and a second end. A coupler removably couples the rod to a protruding member on a plug. The coupler includes a housing having a front wall, a back wall, and a pair of lateral side walls. A bracket has a pair of legs and a middle portion extending between the legs. Each of the legs is securely coupled to an outside surface one of the lateral side walls and extends upwardly therefrom such that the middle portion traverses the housing. The first end of the rod is securely coupled to the middle portion such that the rod extends upwardly from middle portion. The housing has an internal perimeter equal to an outer perimeter of the protruding member for removably positioning around the protruding member. A handle member is integrally coupled to the rod.

1 Claim, 2 Drawing Sheets

TOOL FOR REMOVING DRAIN CAPS

BACKGROUND OF THE INVENTION

1. Field of the Invention

The present invention relates to tools for removing drain caps and more particularly pertains to a new tool for removing drain caps for removing a drain cap.

2. Description of the Prior Art

The use of tools for removing drain caps is known in the prior art. More specifically, tools for removing drain caps heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. Nos. 4,806,170; 4,691,424; 5,003,682; 4,077,103; 5,685,207; and U.S. Des. Pat. No. 261,606.

While these devices fulfill their respective, particular objectives and requirements, the aforementioned patents do not disclose a new tool for removing drain caps. The inventive device includes a rod that elongate and has a first end and a second end. A coupler removably couples the rod to a protruding member on a plug. The coupler includes a housing having a front wall, a back wall, and a pair of lateral side walls. A bracket has a pair of legs and a middle portion extending between the legs. Each of the legs is securely coupled to an outside surface one of the lateral side walls and extends upwardly therefrom such that the middle portion traverses the housing. The first end of the rod is securely coupled to the middle portion such that the rod extends upwardly from middle portion. The housing has an internal perimeter equal to an outer perimeter of the protruding member for removably positioning around the protruding member. A handle member is integrally coupled to the rod.

In these respects, the tool for removing drain caps according to the present invention substantially departs from the conventional concepts and designs of the prior art, and in so doing provides an apparatus primarily developed for the purpose of removing a drain cap.

SUMMARY OF THE INVENTION

In view of the foregoing disadvantages inherent in the known types of tools for removing drain caps now present in the prior art, the present invention provides a new tool for removing drain caps construction wherein the same can be utilized for removing a drain cap.

The general purpose of the present invention, which will be described subsequently in greater detail, is to provide a new tool for removing drain caps apparatus and method which has many of the advantages of the tools for removing drain caps mentioned heretofore and many novel features that result in a new tool for removing drain caps which is not anticipated, rendered obvious, suggested, or even implied by any of the prior art tools for removing drain caps, either alone or in any combination thereof.

To attain this, the present invention generally comprises a rod that elongate and has a first end and a second end. A coupler removably couples the rod to a protruding member on a plug. The coupler includes a housing having a front wall, a back wall, and a pair of lateral side walls. A bracket has a pair of legs and a middle portion extending between the legs. Each of the legs is securely coupled to an outside surface one of the lateral side walls and extends upwardly therefrom such that the middle portion traverses the housing. The first end of the rod is securely coupled to the middle portion such that the rod extends upwardly from middle portion. The housing has an internal perimeter equal to an outer perimeter of the protruding member for removably positioning around the protruding member. A handle member is integrally coupled to the rod.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new tool for removing drain caps apparatus and method which has many of the advantages of the tools for removing drain caps mentioned heretofore and many novel features that result in a new tool for removing drain caps which is not anticipated, rendered obvious, suggested, or even implied by any of the prior art tools for removing drain caps, either alone or in any combination thereof.

It is another object of the present invention to provide a new tool for removing drain caps which may be easily and efficiently manufactured and marketed.

It is a further object of the present invention to provide a new tool for removing drain caps which is of a durable and reliable construction.

An even further object of the present invention is to provide a new tool for removing drain caps which is susceptible of a low cost of manufacture with regard to both materials and labor, and which accordingly is then susceptible of low prices of sale to the consuming public, thereby making such tool for removing drain caps economically available to the buying public.

Still yet another object of the present invention is to provide a new tool for removing drain caps which provides in the apparatuses and methods of the prior art some of the advantages thereof, while simultaneously overcoming some of the disadvantages normally associated therewith.

Still another object of the present invention is to provide a new tool for removing drain caps for removing a drain cap.

Yet another object of the present invention is to provide a new tool for removing drain caps which includes a rod that elongate and has a first end and a second end. A coupler removably couples the rod to a protruding member on a plug. The coupler includes a housing having a front wall, a back wall, and a pair of lateral side walls. A bracket has a pair of legs and a middle portion extending between the legs. Each of the legs is securely coupled to an outside surface one of the lateral side walls and extends upwardly therefrom such that the middle portion traverses the housing. The first end of the rod is securely coupled to the middle portion such that the rod extends upwardly from middle portion. The housing has an internal perimeter equal to an outer perimeter of the protruding member for removably positioning around the protruding member. A handle member is integrally coupled to the rod.

Still yet another object of the present invention is to provide a new tool for removing drain caps that has a pair of ends so that it may open different types of drain caps.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
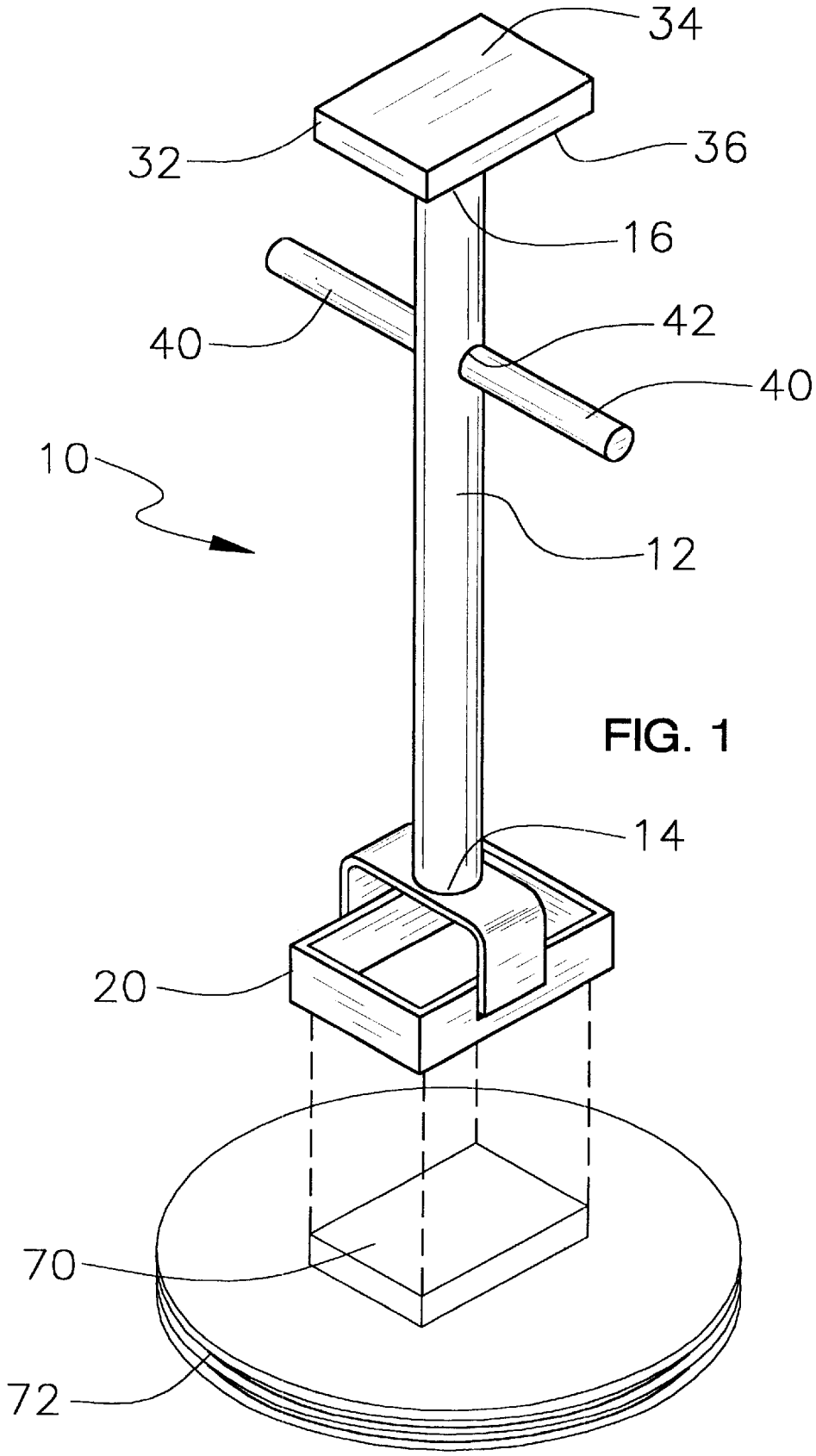
FIG. 1 is a schematic perspective view of a new tool for removing drain caps according to the present invention.
Figure 2:
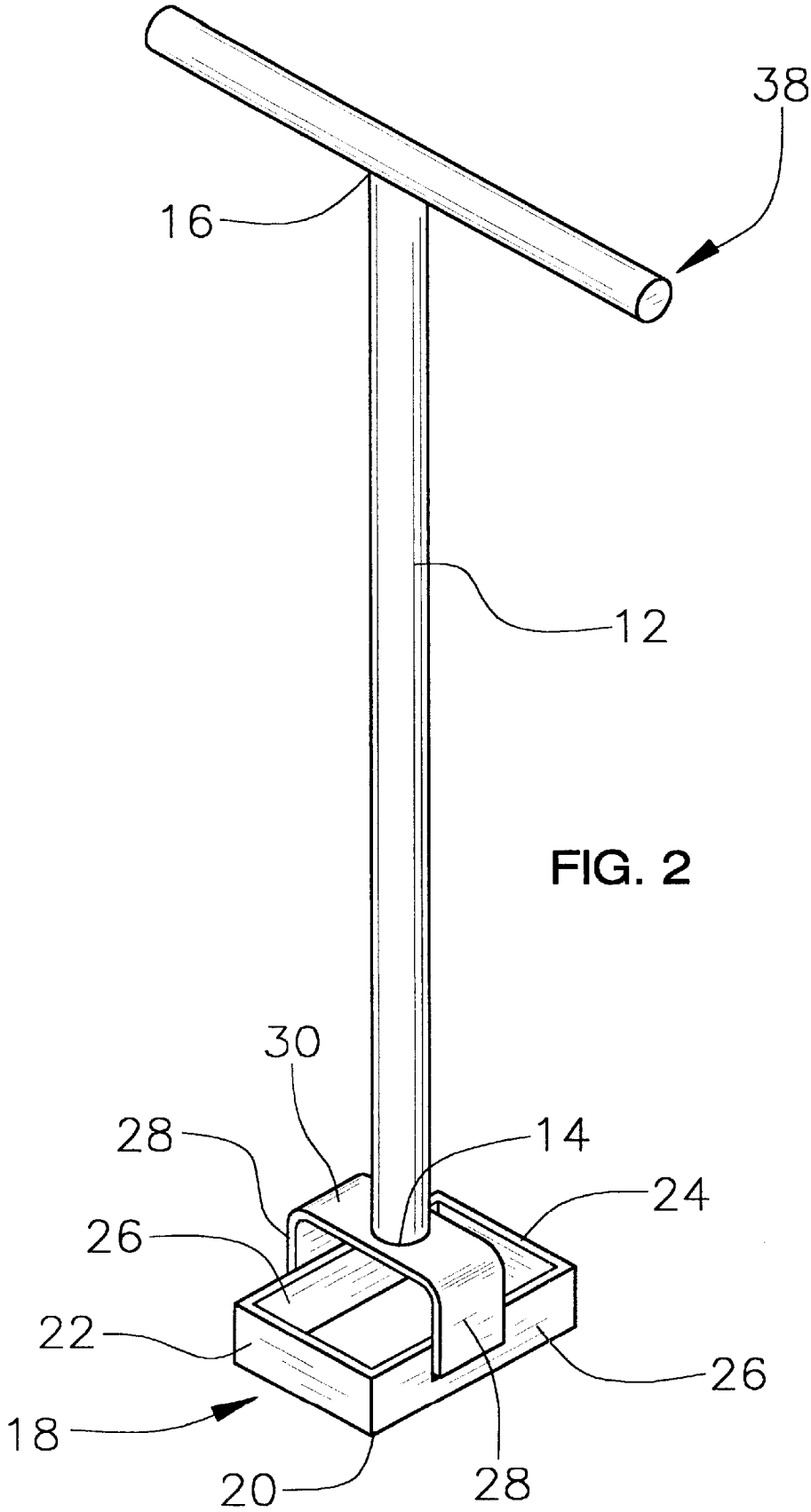
FIG. 2 is a schematic perspective view of the present invention.

With reference now to the drawings, and in particular to FIGS. 1 and 2 thereof, a new tool for removing drain caps embodying the principles and concepts of the present invention and generally designated by the reference numeral 10 will be described.

As best illustrated in FIGS. 1 and 2, the tool for removing drain caps 10 generally comprises a tool for engaging a protruding member 70 integrally coupled to a plug 72, or cap, threadably coupled to a clean out riser in a main sewer line. Alternatively, the cap may have a depression therein for receiving the tool.

The device includes a rod 12, which is elongate and has a first end 14 and a second end 16. The rod 12 preferably has a length generally between 12 inches and 16 inches and a width generally between 1 inch and 2 inches.

A coupler 18 removably couples the rod 12 to the protruding member 70. The coupler 18 includes housing 20 has a front wall 22, a back wall 24, and a pair of lateral side walls 26. A bracket has a pair of legs 28 and a middle portion 30 extending between the legs. Each of the legs 28 is securely coupled to an outside surface one of the lateral side walls 26 and extends upwardly therefrom such that the middle portion 30 traverses the housing 20. The first end 14 of the rod 12 is securely coupled to the middle portion 30 such that the rod 12 extends upwardly from middle portion 30. The housing 20 has an internal perimeter equal to 2 inches wide by 2 inches long which is the size conventionally found on protruding members 70 of drain plug caps 72.

A plate 32 has a top side 34 and a bottom side 36. The second end 16 of the rod 12 is securely attached to the bottom side 36 of the plate 32. The plate 32 has a generally rectangular shape. The top 34 and bottom 36 sides have a length and width equal to 2 inches by 2 inches. The plate 32 has a height equal to ½ inch. The plate 32 may be positioned in a depression located in the cap 72 if the cap 72 has a depression instead of a protruding member 70.

A handle member 38 is integrally coupled to the rod 12. The handle 38 includes a pair of elongated members 40 each having a first end 42 integrally coupled to the rod 12 such that the rods extend away from each other in opposite directions. The rods 12 are positioned generally between the first 14 and second 16 ends of the rod 12.

In use, in the case of a protruding member 70, the housing 20 is positioned around the protruding member 70 and the rod 12 turned. If there is a depression in the cap 72, the plate 32 is positioned therein and the rod rotated. FIG. 2 shows an embodiment without the plate.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A drain plug removal tool for engaging a protruding member integrally coupled to a plug threadably coupled to a clean out riser in a main sewer line, comprising:

a rod being elongate and having a first end and a second end, said rod having a length generally between 12 inches and 16 inches and a width generally between 1 inch and 2 inches;

a coupler for removably coupling said rod to said protruding member, said coupler including housing having a front wall, a back wall, and a pair of lateral side walls, a bracket having a pair of legs and a middle portion extending between said legs, each of said legs being securely coupled to an outside surface one of said lateral side walls and extending upwardly therefrom such that said middle portion traverses said housing, said first end of said rod being securely coupled to said middle portion such that said rod extends upwardly from middle portion, said housing having an internal perimeter equal to 2 inches wide by 2 inches long;

an engaging plate for being removably received in a cavity in a plug, said engaging plate being mounted on the second end of said rod opposite of said coupler, wherein said engaging plate extends outwardly from said rod in a plane oriented substantially perpendicular to a longitudinal axis of said rod, said engaging plate having a top side and a bottom side, said plate having a generally rectanagulr shape, said top and bottom sides having a length and width equal to 2 inches by 2 inches; and a handle member being integrally coupled to said rod, said handle including a pair of elongated members, each of said elongated members having a first end integrally coupled to said rod such that said elongated members extend away from each other in opposite directions, wherein said handle member is spaced from said engaging plate toward said coupler and is spaced from said coupler toward said engaging plate;

wherein said coupler has an internal perimeter substantially corresponding in size and shape to an outer perimeter of said engaging plate.

* * * * *